US007152310B2

(12) United States Patent
Conte

(10) Patent No.: US 7,152,310 B2
(45) Date of Patent: Dec. 26, 2006

(54) CRIMP PRESS FOR THE PRODUCTION OF A CRIMPING CONNECTION

(75) Inventor: Alois Conte, Ebikon (CH)

(73) Assignee: Komax Holding AG, Dierikon (CH)

( * ) Notice: Subject to any disclaimer, the term of this patent is extended or adjusted under 35 U.S.C. 154(b) by 99 days.

(21) Appl. No.: 11/083,170

(22) Filed: Mar. 17, 2005

(65) Prior Publication Data

US 2005/0159029 A1 Jul. 21, 2005

Related U.S. Application Data

(62) Division of application No. 10/373,339, filed on Feb. 24, 2003, now Pat. No. 6,961,992.

(30) Foreign Application Priority Data

Feb. 22, 2002 (EP) ..... 02405130

(51) Int. Cl.
*H01R 43/04* (2006.01)

(52) U.S. Cl. ..... 29/753; 29/748; 29/749; 29/755; 29/759; 29/33 M; 72/442; 72/409.06

(58) Field of Classification Search ..... 29/745–755, 29/759, 33 M, 863, 237; 72/17.3, 21.6, 407–416, 72/442, 450

See application file for complete search history.

(56) References Cited

U.S. PATENT DOCUMENTS 5,765,278 A 6/1998 Koike et al.
6,067,828 A 5/2000 Bucher et al.
6,418,768 B1 7/2002 Meisser et al.
6,961,992 B1 * 11/2005 Conte ..... 29/753

* cited by examiner

*Primary Examiner*—Minh Trinh
(74) *Attorney, Agent, or Firm*—Butzel Long

(57) ABSTRACT

A crimping installation with first and second crimping stations includes at each station a device platform with device stations and a crimp press. A cable is advanced by a tape drive whereby the leading cable end is taken over by a first grip arm arranged on a first swivel arm, which supplies the stripped cable end to the first crimping station. After the leading cable end is provided with a crimping contact, a first swivel arm moves backwards into an axis of the tape drive. Then the tape drive continues to advance the cable until the desired length of a cable section is reached. A separation and a stripping station separates the cable section from the cable and removes the insulation at the cable ends. The lagging cable end of the cable section is taken over by a second grip arm arranged on a second swivel arm which supplies the lagging cable end to the second crimping station for assembly with a crimping contact. With the device stations located on a rotatable disk, a change of a type of contact to another type of contact is possible with minimum downtime of the crimp press.

9 Claims, 6 Drawing Sheets

CRIMP PRESS FOR THE PRODUCTION OF A CRIMPING CONNECTION

This application is a divisional of the U.S. patent application Ser. No. 10/373,339 filed Feb. 24, 2003, which is U.S. Pat. No. 6,961,992, which is issued on Nov. 8, 2005.

BACKGROUND OF THE INVENTION

The present invention relates to a crimp press for the production of a crimping connection by means of a driven crimping device, which device connects an end of a conductor of a cable with a crimping contact.

An installation for the production of a crimping connection is shown in the U.S. Pat. No. 5,966,806. An engine drives an eccentric shaft, which moves up and down a carriage with crimping devices. An encoder, driven by the motor shaft, serves for the indication of the position of the crimping device. The crimping contact, which is to be connected with an end of a conductor, lies on a fixed anvil, whereby the tabs of the crimping contact are plastic deformed by the downward movement of the crimping device and provide the connection to the conductor. The position of the crimping device within the crimping area is measured by means of a height sensor, whereby the sensor signal is employed independently from the encoder signal.

It is a disadvantage of this well-known installation that the crimp press lies idle for a longer time, due to the necessity of device change when processing different crimping contacts. The crimp press, in particular the different crimping device, must be installed for the crimping contact process to be started again. Moreover, the crimping contact supply, the roller and the band with the taped crimping contacts must be changed and then mounted again.

A crimping installation, which comprises several crimping devices located next to each other on an adjustable platform, is shown in the European patent document EP 711 010 B1. The platform is moved until the desired crimping device stops under a fixed drive unit and, by means of this drive unit, the production of crimping connections is operable. Globally, a number of different crimping contacts can be processed, according to the number of crimping devices, whereby this kind of crimping installation is mainly utilized for the production of wire harnesses.

It is a disadvantage of this installation that with the change of contact rollers or crimping devices, the plant must be stopped and partially dismantled.

SUMMARY OF THE INVENTION

The present invention concerns a crimp press for the production of a crimping connection utilizing a mobile crimp device to connect a conductor end of a cable with a crimping contact. A crimping installation includes a pair of crimping stations for connecting opposite ends of cable sections to crimping contacts. The crimping stations include a device platform, at least two device stations mounted on the device platform, each of the device stations having an associated crimp device and an associated supply of crimping contacts, and a crimp press mounted on the device platform, the at least two device stations being movable on the device platform to and away from the crimp press whereby the crimp press individually operates each of the crimp devices, when the associated one of the at least two device stations is moved to the crimp press, to connect a conductor end with one of the crimping contacts from the associated supply. The device platform rotates the at least two device stations around the crimp press.

The device platforms include a rotatable disk carried by a fixed supporting disk and the at least two device stations are mounted on the rotatable disk. A drive is arranged on the supporting disk and has a pinion engaging a toothed ring on the rotatable disk for rotating the rotatable disk. The device platforms include at least one stroke element for engaging and raising the rotatable disk relative to the supporting disk. The at least one stroke element includes a movable ram with a roller whereby when the at least one stroke element engages and raises the rotatable disk, the rotatable disk moves on the roller. A catch is formed on the ram and a slot is formed in the rotatable disk whereby when the catch engages the slot, the at least one stroke element presses the rotatable disk against the supporting disk.

The crimp press according to the present invention solves the objective of avoiding the disadvantages of the well-known installations and provides an installation by which, during the transition of different crimping contacts, no downtimes arise due to the conversion of the crimp press.

The advantages achieved by the crimp press according to the present invention are essentially that when processing different crimping contacts, the crimp devices and the taped crimping contacts may be mounted beforehand. The conversions are carried out outside the crimp press. The productivity of the crimp press can be substantially increased thereby, in particular, when small quantities of the same crimping contacts are processed. The installation, according to the present invention, allows handling with minimum downtimes several different types of contacts successively. This allows rapidly changing to a new type of contact, once a large quantity of one and the same type of contact is terminated.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
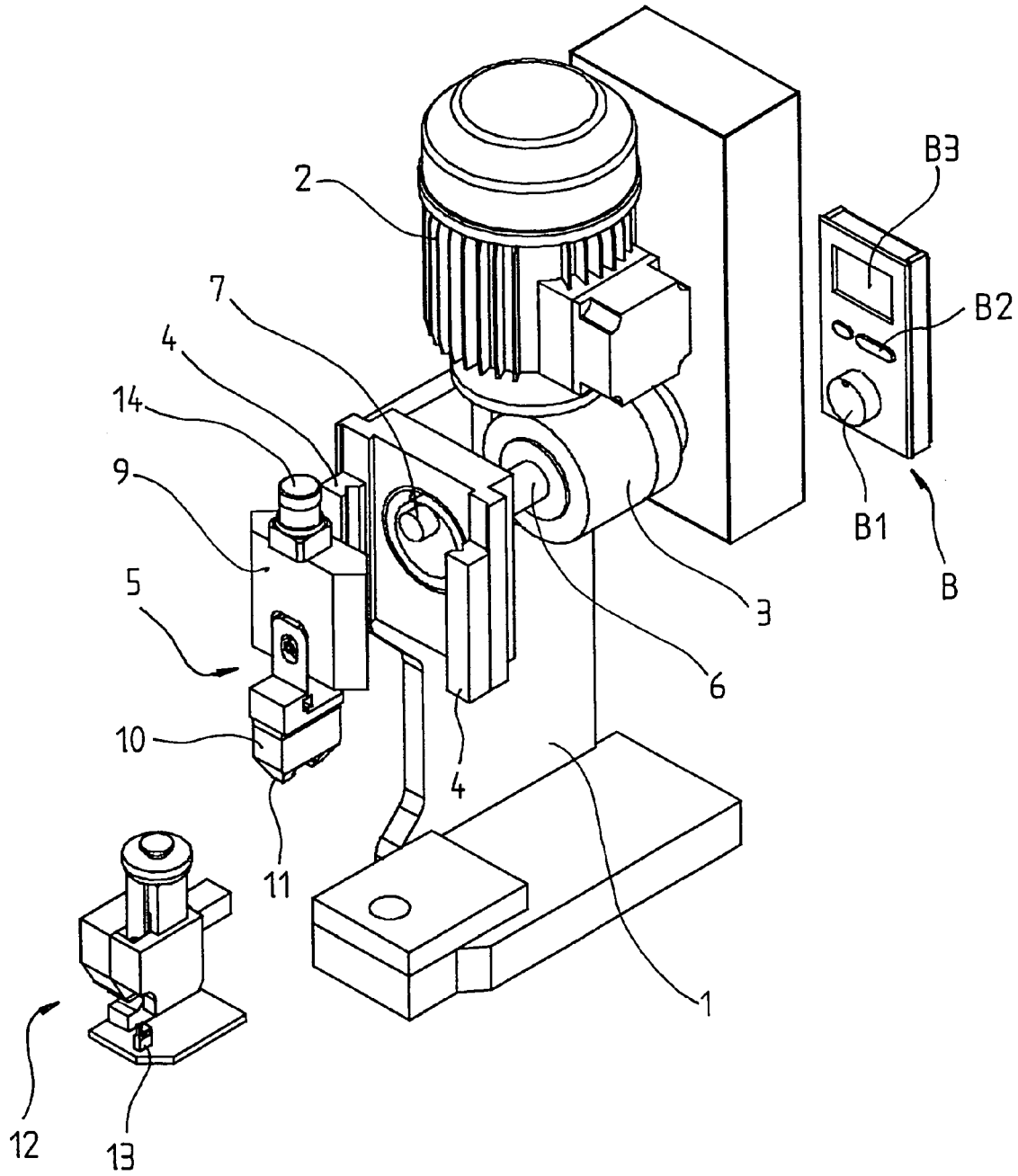
FIG. 1 is a perspective view of a crimp press with a crimp device for the production of a crimping connection according to the present invention.

A crimp press is shown in FIG. 1 having a stand 1 with a right side panel removed, on which an engine 2 is arranged and a gearing 3, mounted on the stand 1, is arranged. In addition, first guides 4 are arranged on the stand 1 along which a crimping ram 5 is vertically guided. A shaft 6, driven by the gearing 3, has an eccentric pin 7 at a free end. The crimping ram 5 includes a carriage 9 guided by the first guides 4 and an attached tool holder 10 with a fork arm 11. The carriage 9 stands in a loose connection with the eccentric pin 7, whereby the rotation of the eccentric pin 7 is converted into a linear vertical up and down movement of the carriage 9. The maximum stroke of the carriage 9 is determined by an upper dead center position and a lower dead center position of the eccentric pin 7. The tool holder 10 operates a crimp device 12, which makes, together with an anvil 13 belonging to the device 12, the crimping connection. By means of an adjusting screw 14, the closing height (shut height) can be adjusted precisely in the lower dead center position of the eccentric pin 7. In case no adjusting wheel is provided for the device 12, the crimping height may be adjusted with the adjusting screw 14 as measured between the anvil 13 and a crimping stamp in the lower dead center position of the eccentric pin 7.

As an interface between an operator and the crimp press, an operator terminal B is provided. For the input of operational data and instructions to a control, the operator terminal B has a turning knob B1 and a keyboard B2 and, for the visualisation of data, an indication display B3 is provided.

Instead of the shown eccentric driving gear, a hydropneumatic linear driving gear or a toggle lever driving gear can, for example, be used.

Figure 3:
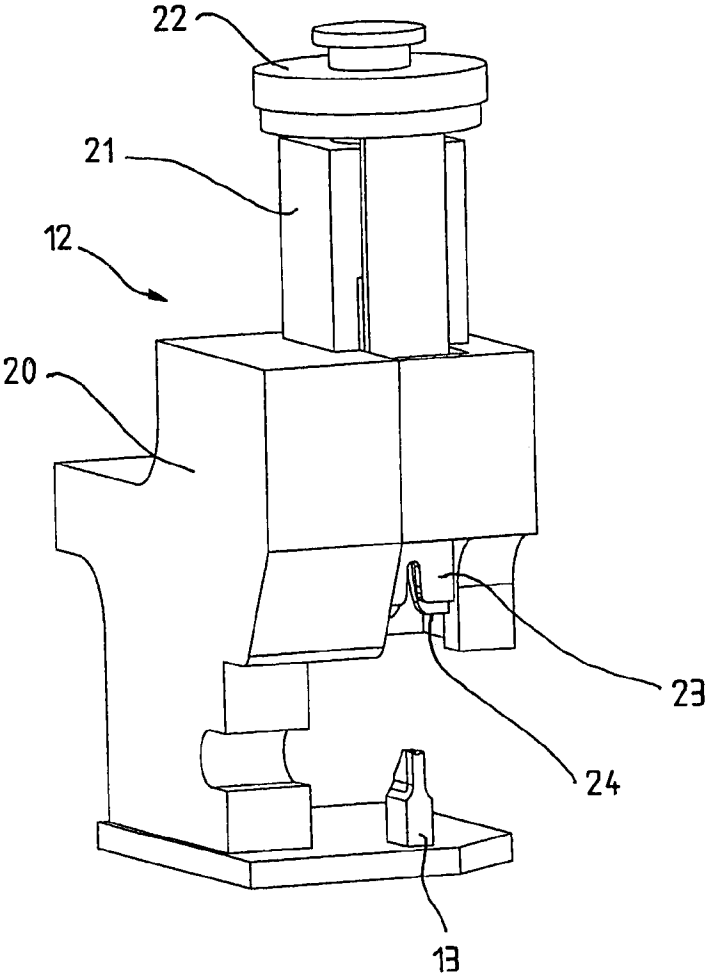
FIG. 3 is a view similar to FIG. 2 with the crimping stamps in an upper dead center position.
Figure 2:
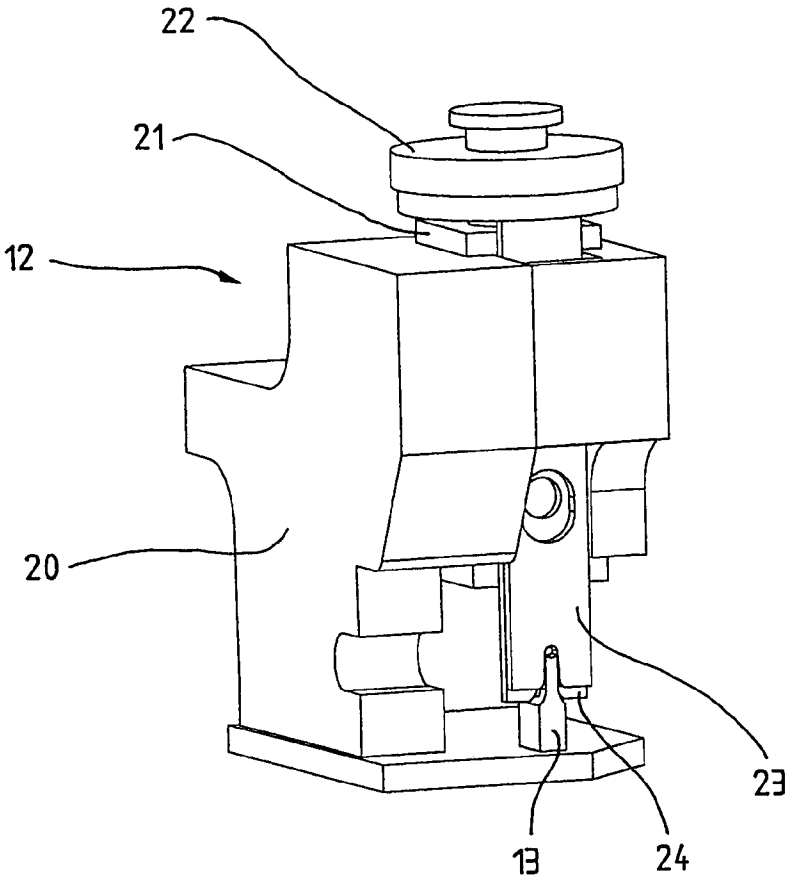
FIG. 2 is a perspective view of the crimp device shown in FIG. 1 with crimping stamps in a lower dead center position.

FIGS. 2 and 3 show details of the crimp device 12 for the production of a crimping connection. A stamp support 21, which is guided into a device housing 20, comprises a support head 22, which stays in loose connection with the fork arm 11 of the tool holder 10. On the stamp support 21 are arranged a first crimping stamp 23 and a second crimping stamp 24. The first crimping stamp 23 and the second crimping stamp 24, together, with the correspondingly formed anvil 13, produce the crimping connection. FIG. 2 shows the crimping stamps 23 and 24 in the lower dead center position of the eccentric pin 7, in which the production of the crimping connection is terminated. FIG. 3 shows the crimping stamps 23 and 24 in the upper dead center position of the eccentric pin 7. The maximum stamp stroke is determined by the dead center positions, whereby the upper and the lower dead center positions will not be crossed.

Figure 4:
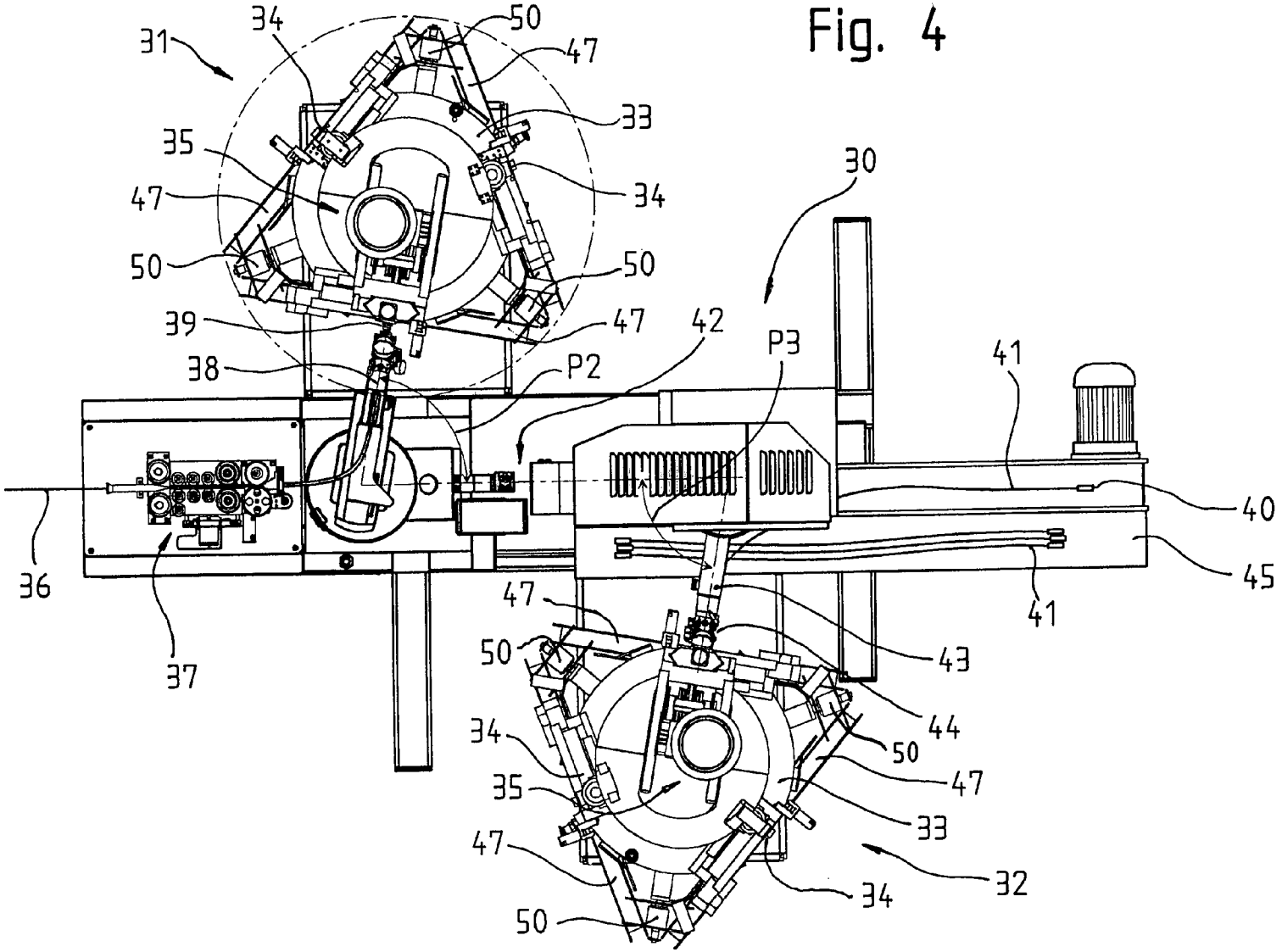
FIG. 4 is a plan view of a crimping installation with a first crimping station and a second crimping station according to the present invention.

FIG. 4 shows a crimping installation 30 with a first crimping station 31 and a second crimping station 32. At each of the crimping stations 31 and 32 there are provided a device platform 33 with three device stations 34 and a crimp press 35. The crimping stations 31 and 32 are identical in their structure. A cable 36 is advanced by means of a tape drive 37 along a path extending between the crimping stations whereby the leading cable end is taken over by a first grip arm 39 arranged at a first swivel arm 38. The first grip arm 39 supplies the stripped cable end to the first crimping station 31. The movement of the first grip arm 39 is indicated with an arrow P2 wherein the first swivel arm 38 pivots between a position aligned with the cable path and a position generally transverse to the cable path. After that the leading cable end is provided with a crimping contact 40, the first swivel arm 38 moves itself backwards into the axis of the tape drive 37. Thereafter, the tape drive 37 pushes the cable 36 further forwards along the cable path until the desired length of the cable section 41 is reached. A separation and stripping station 42 separates the cable section 41 from the cable 36 and removes the insulation at the just cut adjacent cable ends. The lagging cable end of the cable section 41 is taken over by a second grip arm 44 arranged at a second swivel arm 43. The second grip arm 44 supplies the lagging cable end to the second crimping station 32 for assembly with another crimping contact 40. The movement of the second grip arm 44 is similar to the movement of the first grip arm 39 as indicated with an arrow P3. The new leading cable end of the cable 36 will be supplied for assembly to one of the crimping contacts 40 by the first swivel arm 38 and the first grip arm 39 of the first crimping station 31. After assembly of the crimping contacts 40 at both ends, the cable section 41 is moved into a deposit station 45.

Figure 5:
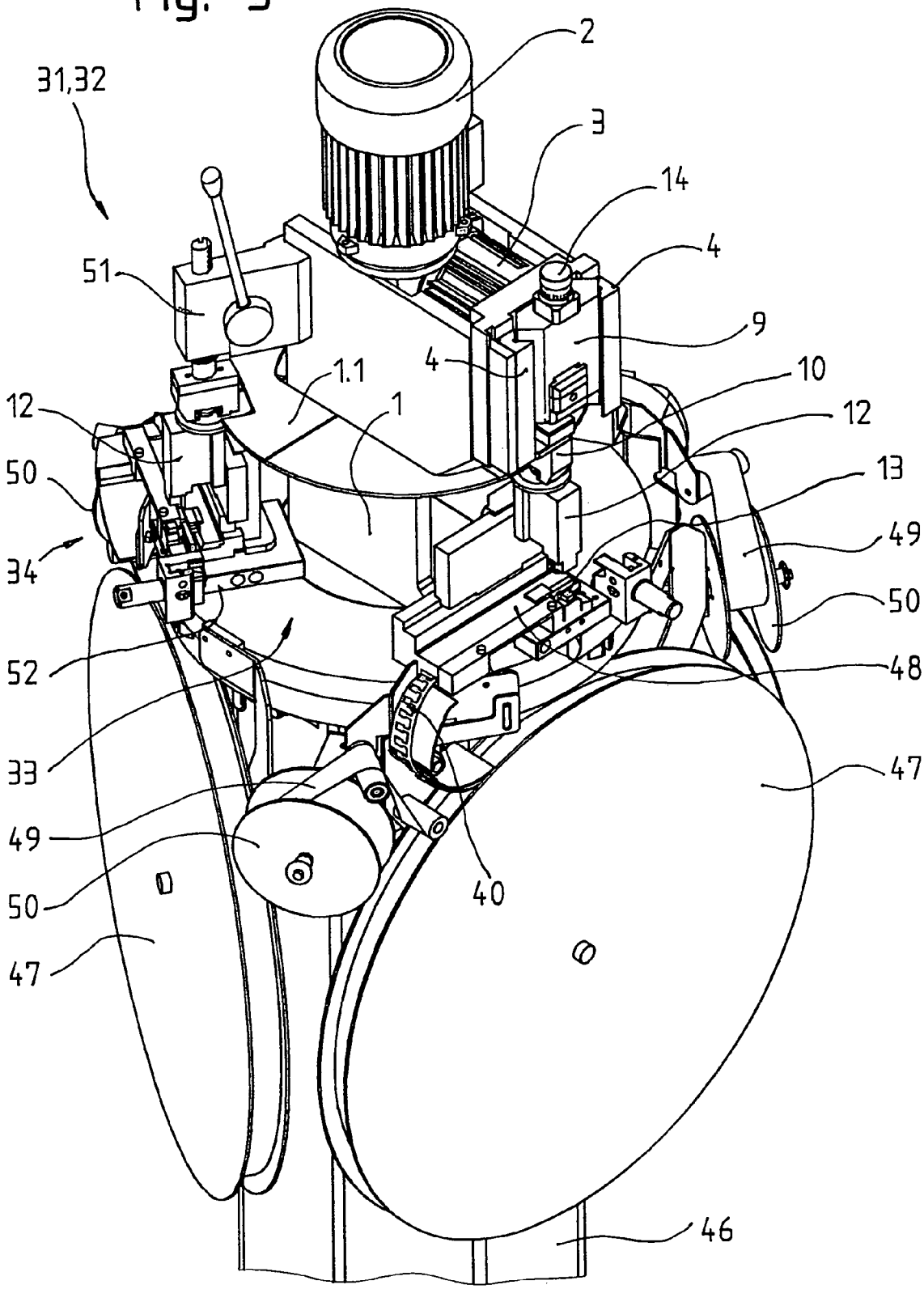
FIG. 5 is a perspective view of either of the crimping stations shown in FIG. 4.

FIG. 5 shows details of the crimping stations, 31 and 32, which essentially consist of the device platform 33 with three of the device stations 34 mounted thereon with the attached crimp press 35. The device platform 33 is arranged at a base 46. Details of the device platform 33 are described in connection with the FIGS. 6 and 7. For each of the device stations 34 there is a contact roller 47 with a roll of the crimping contacts 40 attached side-by-side in a strip whereby the crimping contacts 40 are supplied to a contact feed 48. A cover band 49 over the strip of the contacts 40 is rolled up by means of a conveyor drum 50. In FIG. 5, there is shown one of the device stations 34 at the crimp press 35, a second one of the device stations 34 at a hand press 51, a third one of the device stations 34 is not visible behind the crimp press 35. The device stations 34 essentially consist of the contact roller 47 with the rolled strip of the crimping contacts 40, the conveyor drum 50, the contact feed 48, the crimp device 12 and a console 52 arranged on the device platform 33. The device stations 34 are prepared at the hand operated press position. The crimping contact band 49 is inserted, the crimp device 12 is adjusted, the crimping contacts 40 are separated with the hand operated press 51 and the feed of the crimping contacts 40 is examined. Instead of the hand operated press configuration shown, installation stations developed in a different way are conceivable. A positioning plate 1.1, being firmly connected with the stand 1, serves as a support plate for the stamp support 21, whereby the stamp support 21 is held in a position for entry into the crimp device 12. During the next contact change, the device platform 33 is turned counterclockwise by 120°, so that the device station 34 shown at the hand operated press 51 stops at the position of the crimp press 35.

FIG. 5 shows the device platform 33 with three device stations 34. With a larger platform radius, more than three of the device stations 34 can be attached to the device platform. A device platform with only two of the device stations 34 is also conceivable.

Figure 6:
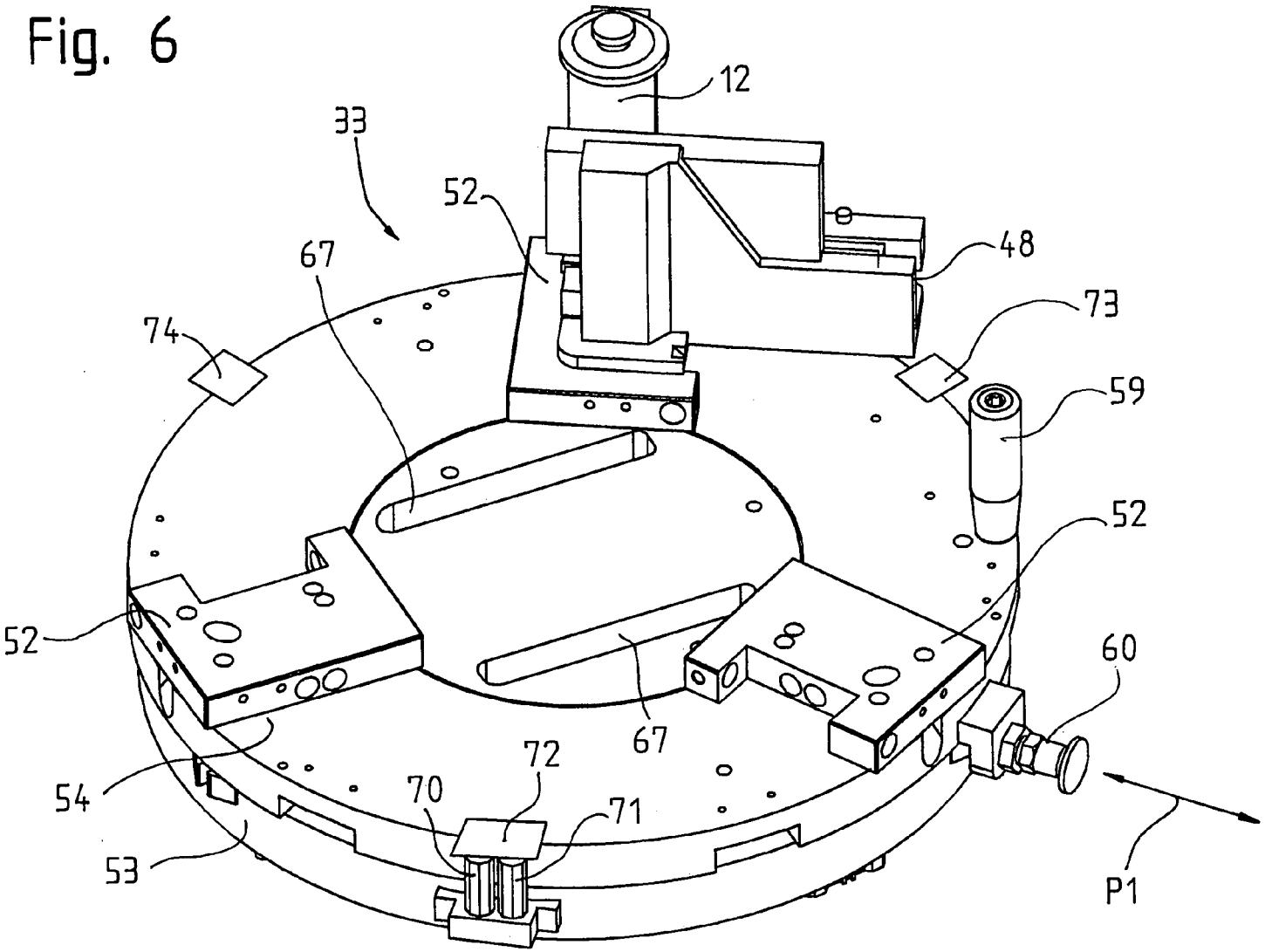
FIG. 6 is a perspective view of the device platform shown in FIG. 5.
Figure 7:
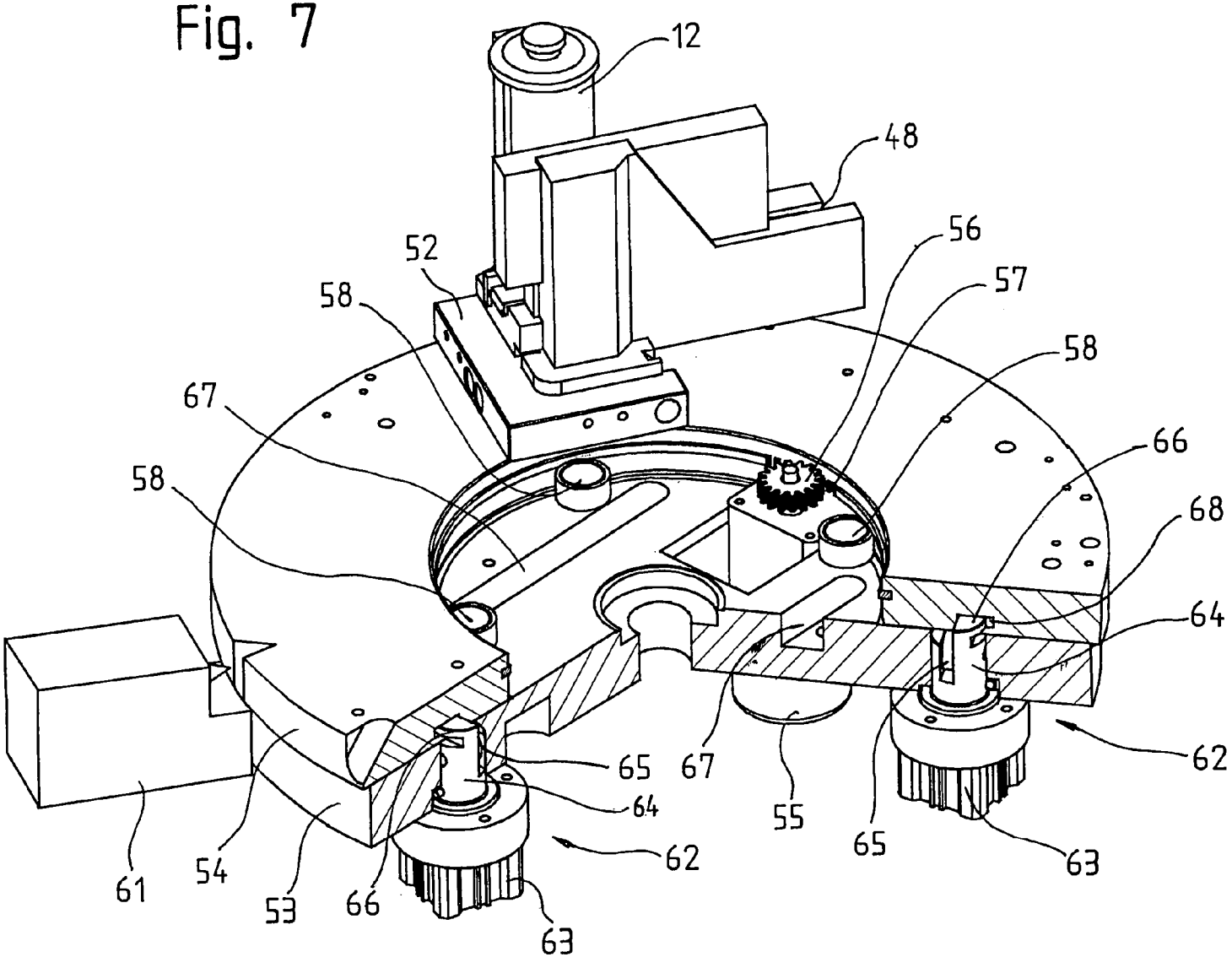
FIG. 7 a view similar to FIG. 6 with a portion of the device platform cut away.

FIGS. 6 and 7 show details of the device platform 33, which exhibits a fixed supporting disk 53, on which a rotatable ring 54 is mounted. The rotatable ring 54 carries the device stations 34 including the consoles 52, the contact rollers 47 and the conveyor drums 50. A drive 55 is arranged at the supporting disk 53 and drives, by means of a pinion 56, the rotatable ring 54. The pinion 56 drivingly engages with a toothed ring 57 arranged on an inner periphery of the rotatable ring 54. The rotatable ring 54 is guided by guide rolls 58 arranged on the supporting disk 53.

For the positioning of the rotatable ring 54, an encoder is arranged at the drive 55 and generates signals that are used for the determination of the disk position. A further variant for the positioning of the rotatable ring 54 is shown in FIG. 6. Two sensors 70 and 71 are arranged on the supporting disk 53, and the two sensors 70 and 71 are operable by means of tabs 72, 73 and 74 arranged on the rotatable ring 54. In the shown position, the tab 72 operates both of the sensors 70 and 71. The tab 73 is arranged in such a way that, in the stopped position of the rotatable ring 54, only one of the sensors is operated. The tab 74 is arranged in such a way that, in the stopped position of the rotatable ring 54, only the other one of the sensors is operated.

The rotatable ring 54 also can be moved by a grab handle 59 (FIG. 6). For the releasable fixing of the rotatable ring 54 at a desired rotational position, a retention hook 60 (FIG. 6), manually operable in a direction of an arrow P1, is provided on the supporting disk 53. Instead of the retention hook 60, an automatic retention installation 61 (FIG. 7) can be provided. Recesses 67 are formed in the center of the supporting disk 53 for the reception of the side panels of the stand 1.

Before being moved, the rotatable ring 54 is raised by means of stroke elements 62 (FIG. 7). Each of the stroke elements 62 consists of a drive, for example a pneumatic cylinder 63, which operates a ram 64. On the top of each of the rams 64, a roller 65 is arranged, on which the rotatable ring 54 is moved. After the rotatable ring 54 has been moved to and locked in a desired position, the rams 64 are moved downwards. A catch 66, which is arranged on each of the rams 64, engages a corresponding slot 68 formed in the rotatable ring 54 and presses the disk 54 against the fixed supporting disk 53.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A crimping installation for the production of cable sections having a crimping contact connected at opposite ends thereof comprising:

a tape drive for feeding a length of cable;

a separation and stripping station for cutting a cable section from the length of cable and stripping insulation from adjacent cable ends; and a first crimping station for connecting a crimping contact to a leading end of the cable section and a second crimping station for connecting a crimping contact to a trailing end of the cable section, each said crimping station having at least two device stations mounted on a device platform, each said device station having an associated crimp device and an associated supply of the crimping contacts, and each said crimping station having a crimp press mounted on said device platform, said at least two device stations being movable on said device platform to and away from said crimp press whereby said crimp press individually operates each said crimp device, when said associated one of said at least two device stations is moved to said crimp press, to connect one of the leading and trailing ends with one of the crimping contacts from said associated supply.

2. The crimping installation according to claim 1 wherein each said device platform includes a rotatable ring carried by a fixed supporting disk and said at least two device stations are mounted on said rotatable ring.

3. The crimping installation according to claim 2 including a drive arranged on said supporting disk and having a pinion engaging a toothed ring on said rotatable ring for rotating said rotatable ring.

4. The crimping installation according to claim 1 including at least one stroke element for engaging and raising said rotatable ring relative to said supporting disk.

5. The crimping installation according to claim 4 wherein said at least one stroke element includes a movable ram with a roller whereby when said at least one stroke element engages and raises said rotatable ring, said rotatable ring moves on said roller.

6. The crimping installation according to claim 5 including a catch formed on said ram and a slot formed in said rotatable ring whereby when said catch engages said slot, said at least one stroke element presses said rotatable ring against said supporting disk.

7. The crimping installation according to claim 2 including a retention hook attached to said supporting disk for engaging and preventing movement of said rotatable ring.

8. The crimping installation according to claim 2 including an automatic retention installation attached to said supporting disk for engaging and preventing movement of said rotatable ring.

9. The crimping installation according to claim 2 including at least one position sensor attached to said supporting disk and at least one tab attached to said rotatable ring for operating said at least one position sensor.

* * * * *